US006257816B1

(12) United States Patent
Frich

(10) Patent No.: US 6,257,816 B1
(45) Date of Patent: Jul. 10, 2001

(54) BOOK BINDING ORIENTATION DETECTOR

(76) Inventor: Mark R. Frich, 12 Ferndale St., Maplewood, MN (US) 55119

( * ) Notice: Subject to any disclaimer, the term of this patent is extended or adjusted under 35 U.S.C. 154(b) by 0 days.

(21) Appl. No.: 09/483,516

(22) Filed: Jan. 14, 2000

(51) Int. Cl.[7] ..... B42C 13/00

(52) U.S. Cl. ..... 412/1; 412/11; 412/19; 198/689.1

(58) Field of Search ..... 412/4, 11, 19, 412/9, 1, 14, 18, 25; 198/689.1

(56) References Cited

U.S. PATENT DOCUMENTS 4,009,498 * 3/1977 Staats et al. ..... 412/19 X
5,066,183 * 11/1991 Thulerus ..... 412/11
5,413,447 * 5/1995 Rathert ..... 412/19
5,429,468 * 7/1995 Kujima ..... 412/19
5,871,323 * 2/1999 Clark ..... 412/4

* cited by examiner

*Primary Examiner*—Willmon Fridie, Jr.
(74) *Attorney, Agent, or Firm*—Robert A. Pajak; W. Kevin Roloff

(57) ABSTRACT

A book binding orientation locator method and apparatus includes a pair of upper and lower platforms in pivotal arrangement. The lower platform has a plurality of vacuum suction cups connected to a vacuum line for adhering to an upper cover of a book. Upon lifting the upper platform relative to the book, and depending upon how the lower platform pivots relative to the upper platform, the book-binding side of the book may be determined.

29 Claims, 4 Drawing Sheets

BOOK BINDING ORIENTATION DETECTOR

FIELD OF THE INVENTION

The present invention relates generally to systems and apparatuses for handling library materials.

BACKGROUND OF THE INVENTION

Modern libraries have experienced increased demands from patrons, in terms of needs for larger and larger holdings of books and other tangible materials. Accordingly, it is not uncommon for public libraries, for example, to handle collection and distribution of hundreds of thousands, or even millions of books and materials every year. Tasks of libraries in handling these ever-increasing volumes are often overwhelming where manual labor is employed for such tasks.

In response to such growing volumes of materials, automated methods and systems for materials handling have been developed for library environments as taught in U.S. Pat. No. 6,074,156, entitled, "Library Cart Loading System and Method", issued to Mark R. Frich, an inventor of the present invention. In such systems, library materials are received from a "book" depository, transported to a check-in system for subsequent cataloging and inventory update, and ultimately placed on carts for subsequent re-shelving for subsequent patron requests or browsing.

In the aforementioned automated systems, it is important to know the book binding orientation of a book prior to subsequent operations such as loading books onto a cart. Procedures for determining book-binding orientation may include squaring operations in addition to various electronic sensing, for example the location of a barcode or the like. Such procedures for determining book binding orientation are generally expensive, and add to the overall complexity and cost of the library materials handling system. Thus there is a need for a simple bookbinding orientation locator method and apparatus which may be applicable to not only library material handling systems, but also book publishers or other applications requiring knowledge of the book binding orientation of a book.

SUMMARY OF THE INVENTION

An object of the invention is to provide a method and apparatus for determining book binding orientation.

In accordance with the present invention, book binding orientation of a book is determined by a pair of platforms in pivotal arrangement. One of the platforms has a plurality of vacuum suction cups connected to a vacuum line for lifting the cover. Depending upon how this platform pivots, the book-binding side of the book may be determined.

DETAILED DESCRIPTION OF THE INVENTION

Figure 1:
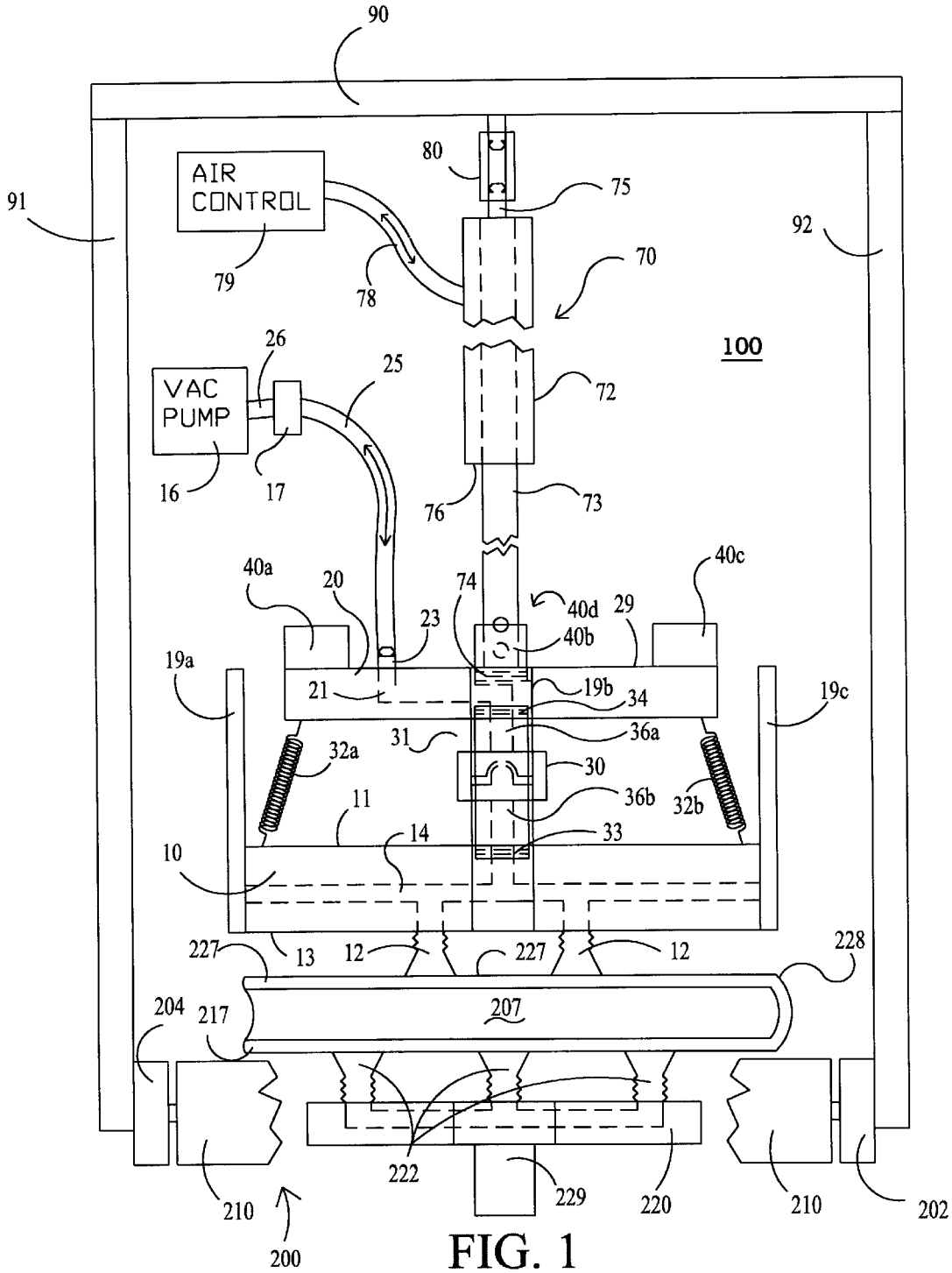
FIG. 1 is a side plan view of a book binding orientation locator in accordance with the present invention.

Illustrated in FIG. 1 is plan view of the book binding orientation locator in accordance with the preset invention. The book binding orientation locator is particularly applicable for automated library material handling systems employing a conveyor system for transporting materials from an input side, such as a library receiving or return station, to a book placing station as particularly described in the aforesaid U.S. Pat. No. 6,074,156. In the aforesaid patent application, the placer system is intended to place books on a library cart such that the books are in an upright condition with their binding facing outward (or at least in the same direction).

Figure 2:
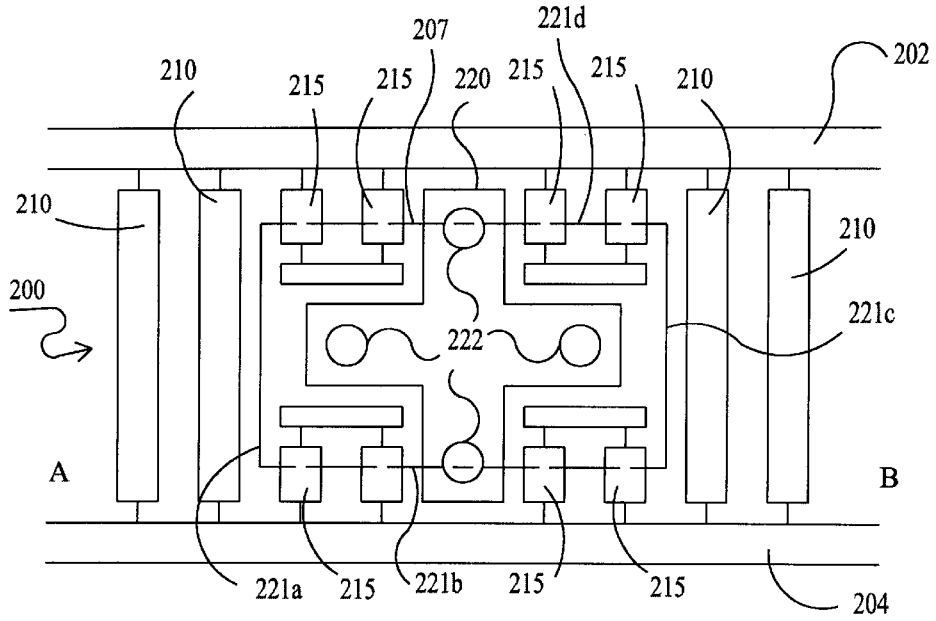
FIG. 2 is a plan view of a book transport conveyor and a book rotator in accordance with the present invention.

An exemplary motorized conveyor transport system 200 (driving members and motors not shown) for a library material handling systems is generally depicted in the plan view illustrated in FIG. 2. A pair of rails 202 and 204 hold a plurality of conveyor rollers 210 which are coupled to a drive means (not shown) for transporting library materials, for example book 207 along the conveyor to various operating stations for performing particular tasks such as squaring, de-shingling reading bar codes, de-magnetizing operations, and finally to selected placer stations for stacking books onto library carts.

Further illustrated in FIG. 2 is a cross-shaped rotator platform 220 surrounded by further smaller conveyors 215 which are also coupled to drive means not shown for moving book 207 any where along the conveyor transport system 200 from point A to point B, as desired. In the operation of the book binding orientation locator in accordance with the present invention, as will be subsequently described, the conveyor transport system 200 is intended to transport book 207 so as to be in juxtaposition with rotator platform 220, and in rough square alignment relative with rail members 202 and 204, and centrally therebetween. It should be noted that rotator platform 220 is held in vertical alignment relative to side rails 204 and 202 by way appendages not shown. Further, it should be assumed that rotator platform 20 lies at least just below the upper extremities of rollers 210 and 215, as particularly illustrated in FIG. 1, so as to permit book to be transported without obstruction from A to B as desired and under control of the transport system.

As is further illustrated in FIGS. 1 & 2, book 207 includes side 221*a* opposite side 221*c*, and side 221*b* opposite side 221*d*. As is depicted in FIG. 2, book sides 221*a* and 221*c* are in general transverse alignment with respect to the direction of the intended movement of book 207 from A to B along the conveyor transport system 200; whereas book sides 221*b* and 221*d* are generally in parallel alignment with the intended movement book of 207 along conveyor transport system 200. Lastly, as further illustrated in FIG. 2, book 207 is intended to be transported to the book binding locator of the present invention such that book 207 is generally centrally positioned between the conveyor rails 202 and 204, and over rotator 220.

The alignment and position of book 207 as just described and depicted in FIG. 2 may be accomplished by a book centering and squaring station (not shown) for providing the desired book position and book orientation before the book is transported to a position just above rotator platform 220 as illustrated. Upon the proper positioning of book 207 over rotator platform 220, the conveyor transport is intended to cease transport of book 207 until the location of the book binding 228 is located as will subsequently be described.

Figure 3:
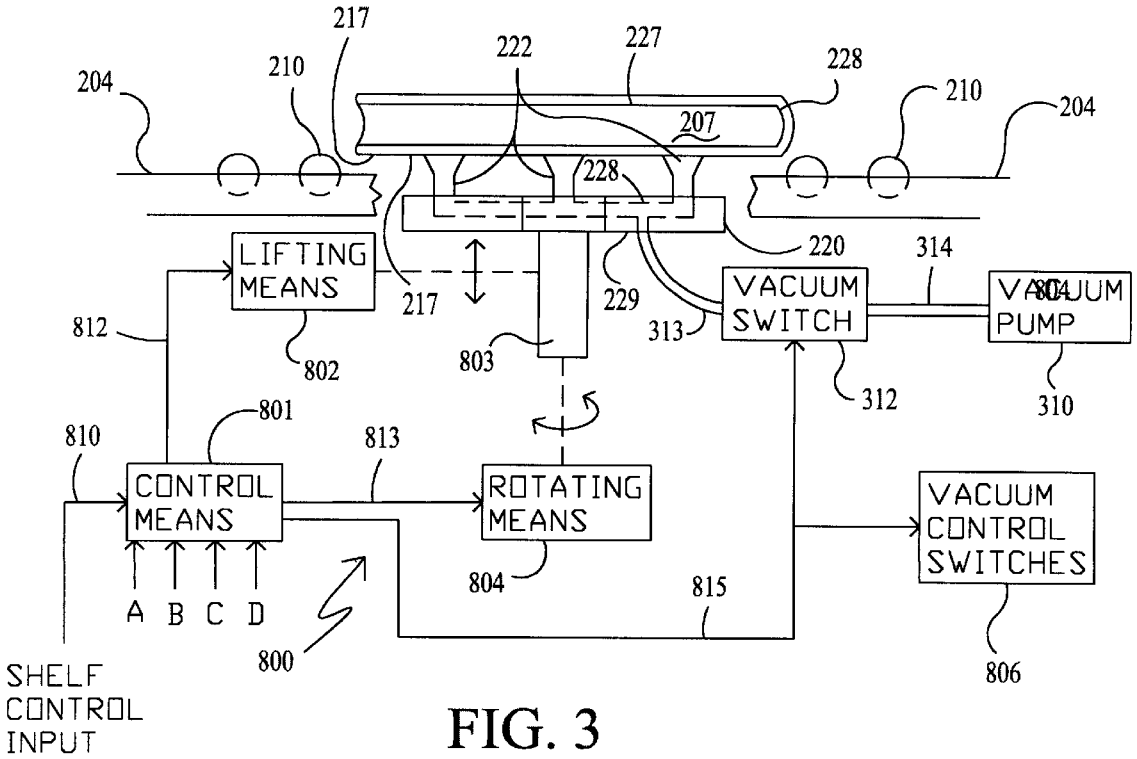
FIG. 3 is a schematic block diagram of a control system for the book rotator of FIG. 2 in cooperation with the book binding orientation locator in accordance with the present invention.

Illustrated in FIG. 3 is a side view of the conveyor transport system 200 and rotator platform 220 and associated controls. In the preferred embodiment of the book binding orientation locator in accordance with the present invention, rotator platform 220 includes a plurality of bellows type vacuum cups 222 in communication with air passages or chambers 228 forming a manifold. Chambers 228 are coupled to a vacuum pump 310 through a vacuum switch 312 having an air line 313 on one side of vacuum switch 312 connected to air passages 228, and the other side thereof connected to vacuum pump 310 through air line 314. With book 207 properly positioned, cover 217 of book 207 rests on, or in close proximity to, the ends of cups 222. In accordance with the present invention, with vacuum switch in an open switch, vacuum pump 310 is operative to cause a sucking action upon cover 217 so as to securely adhere cover 217 to rotator platform 220.

Again referring to FIG. 1, thereshown is book 207 with cover 217 resting on vacuum cups 222 associated with rotator platform 220. As illustrated, binding 228 of book 207 faces to the right.

Figure 4:
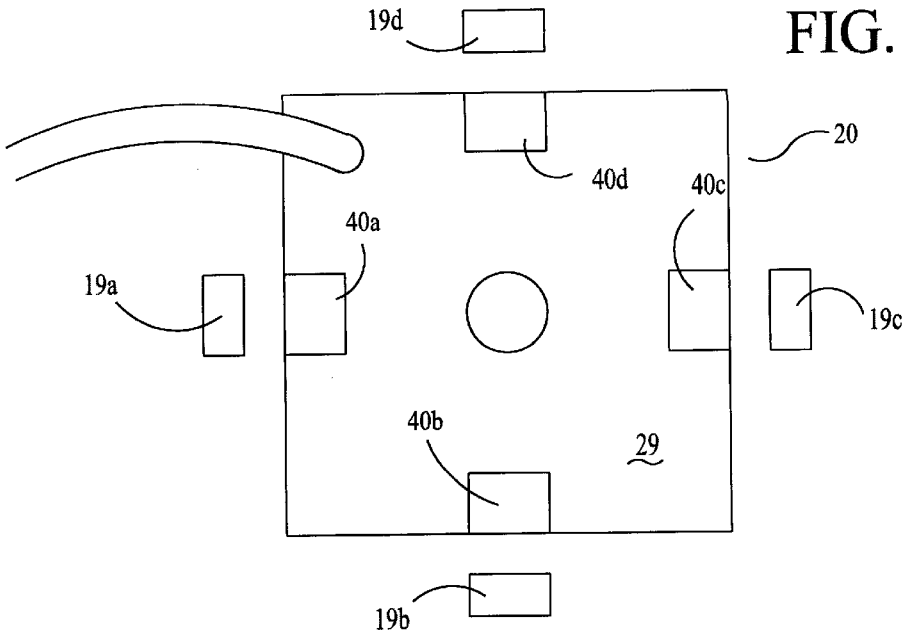
FIG. 4 is a partial top plan view of book binding orientation locator of FIG. 1 particularly illustrating the sensor platform in accordance with the present invention.
Figure 5:
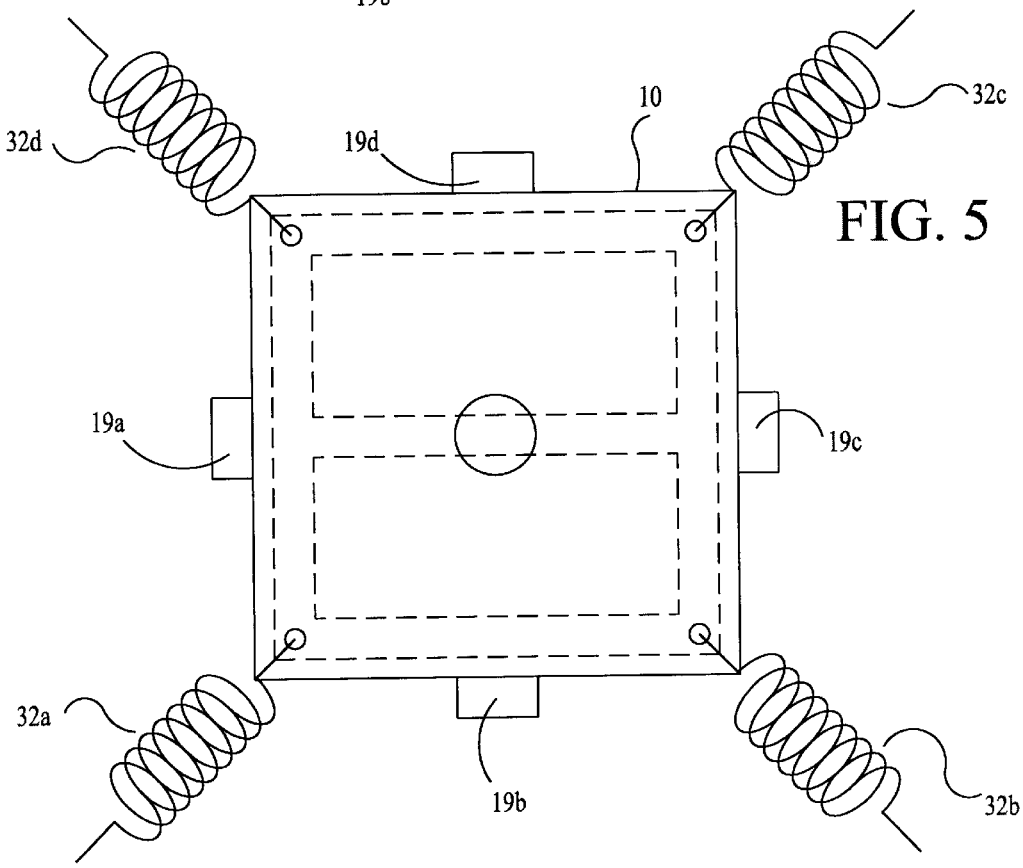
FIG. 5 is a partial top plan view of book binding orientation locator of FIG. 1 particularly illustrating the reference platform in accordance with the present invention.

As illustrated in FIGS. 1, 4, and 5, the book binding orientation locator 100 includes a generally square shaped sensing platform 10 pivotally coupled to a generally square-shaped reference platform 20 by way of a vacuum swivel joint 30 and four symmetrically placed light (low spring force) helical dampening springs 32 *a–d*. Springs 32*a–d* are generally positioned so as to resiliently couple the sensing platform 10 to the reference platform 20 in generally symmetrical alignment—namely, one corner of the sensing platform is coupled to a corresponding corner portion of the reference platform. As illustrated in the drawings, reference platform 20 is somewhat smaller than sensing platform 10.

In the preferred embodiment of the present invention, sensing platform 10 includes a plurality of bellows type vacuum cups 12 in communication with air passages or chambers 14 forming a manifold therein. Sensing platform 20 includes a plurality of air passages 21 terminating at a vacuum line port or stub 23 for receiving an air line 25 coupled to one side of vacuum switch 17. The other side of vacuum switch 17 is coupled to vacuum pump 16 through airline 26.

Sensing platform 20 is pivotally coupled to reference platform 10 through vacuum swivel joint 30 as aforesaid. The upper end 31 of joint 30 is intended to be rigidly coupled to reference platform 20 by way of screw-thread end member 34 and threaded aperture, generally indicated by numeral 35, in a well-known manner. Similarly, lower end 33 of joint 30 is intended to be rigidly coupled to sensing platform 10. As is well-understood, joint 30 includes an air passage therethrough extending from end 31 to end 33 as depicted by numerals 36*a* and 36*b*. In the preferred embodiment of the invention, air passages 21 are intended to be communication with air passages 14 through joint 30 by way of air passages 36*a* and 36*b*.

With the arrangement as just described, chambers 14 are coupled to vacuum pump 16 through vacuum swivel joint 30, air passages 21 of sensing platform 20, and vacuum switch 17 so as to be operative to cause a vacuum action upon the upper book cover 227 of book 207 through vacuum cups 12 as will be subsequently described.

Referring to FIGS. 1, 4, and 5, affixed to reference platform 10 are four extension members 19*a–d* extending perpendicular to surface 11 of platform 10. Further, affixed to sensing platform 20 are a plurality of "electric eye" proximity type sensing devices 40*a–d*. Each sensing device 40 is intended to embody both an emitter and a detector. In an exemplary embodiment of the invention, sensing device 40 is intended to emit red light, and detect reflections thereof.

The arrangement of sensing devices 40*a–d* and extension members 19*a–d* is particularly illustrated with reference to FIG. 4. Considering the "pick-up" position of book binding orientation locator in accordance with the present invention as illustrated in FIG. 1, each of the extension members 19*a–d* is intended to be in alignment with a corresponding one of the sensing devices 40*a–d*. Further, the length of each of the extension members is intended to be such that each of the sensing devices 40*a–d* will "not" sense any reflection of its own emitted light reflected from the corresponding one the extension members 19*a–d*, respectively. However, the arrangement is intended to be such that rotation of sensing platform 1 0 about joint 30 relative to reference platform 20 may be sensed by predetermined ones of sensing devices 40*a–d* as will be further described.

Again referring to FIG. 1, book binding orientation locator 100 in accordance with the present invention further includes an air actuated linear actuator 70 including an air cylinder 72 and a push rod 73. Cylinder end 75, opposite push rod end 76, is resiliently coupled to frame member 90 through a ball-like-joint 80. Push rod 73 has one end rigidly confined within cylinder 72, and the other end 74 thereof rigidly coupled to reference platform 20 and arranged so as to be perpendicular to surface 29 thereof. Push rod 73 may be rigidly attached to platform 20 by way of a screw-tread type coupling or the like (not shown).

Frame member 90 is intended to be held in fixed relationship relative to rotator platform 220 by way of exemplary frame members 91 and 92 having one end of each frame member 91 and 92 rigidly affixed to side rails 204 and 202, respectively. In an exemplary embodiment of the present invention, joint 80 may be provided by way of a simple hose for coupling end 75 of actuator 70 to member 90.

In the preferred embodiment, actuator 70 is intended to be a double acting cylinder with a square push rod. Cylinder 72 is intended to be coupled to an air control by way of an air line 78.

Figure 6:
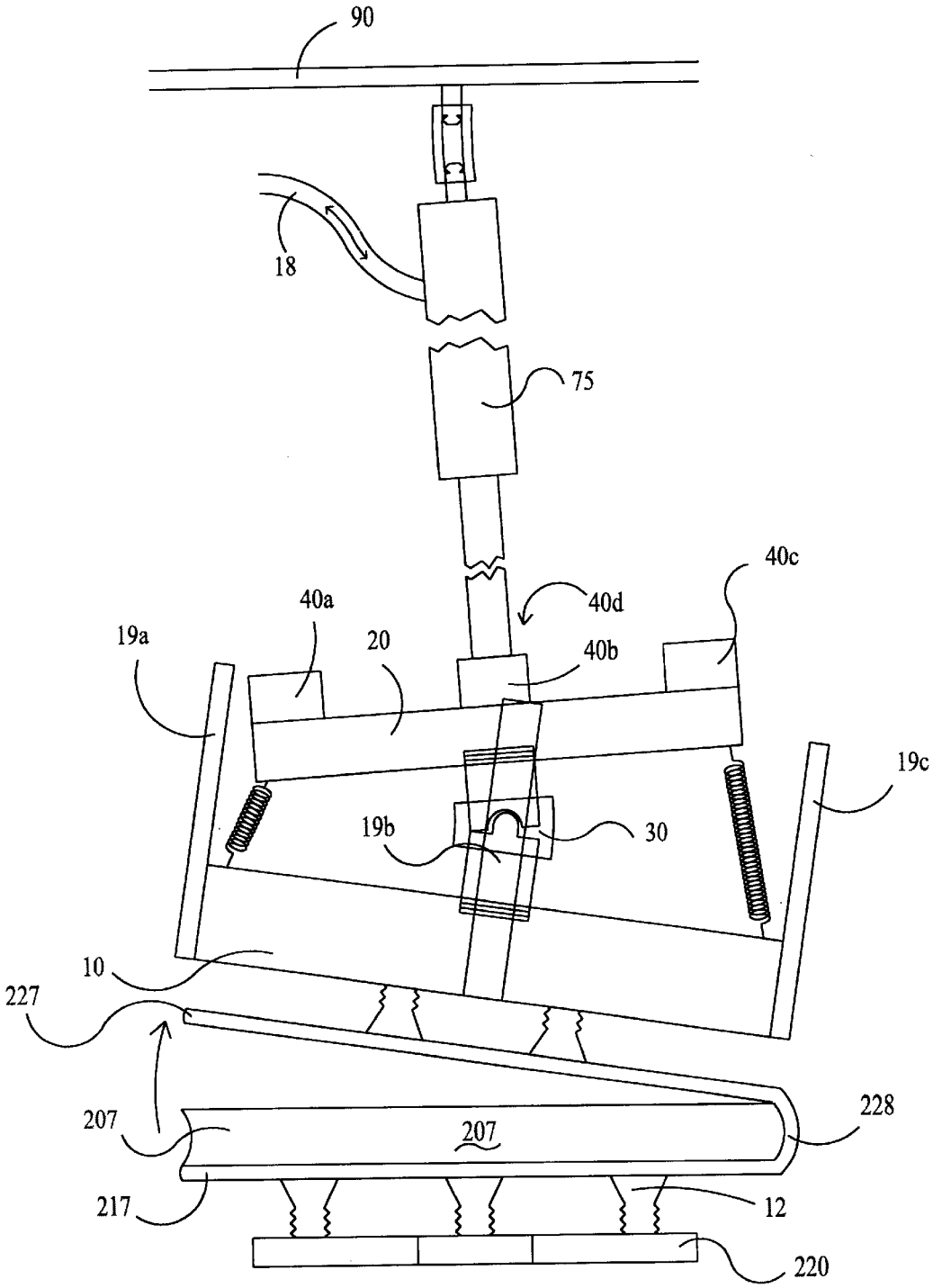
FIG. 6 is a partial side plan view of book binding orientation locator of FIG. 1 particularly depicting an operative condition.

The operation and the method of the book binding orientation locator in accordance with the present invention will now be described with reference to FIGS. 1 & 6 depicting the cooperation of the various components configured in a manner as aforesaid with like components having retained to same numeral designations as the previous described Figures. Book binding orientation locator 100 awaits the transport of a book 207 in juxtaposition over cross-shaped rotator platform 220. It should be again noted that transport conveyor is intended to include a sensing device so as to stop further transport of book 207 along transport conveyor 200 upon proper placement of book 207 over cross-shaped platform 220. Further, it should be further assumed in the following exposition that book 207 is generally aligned relative to rails 202 and 204, and centrally located therebetween by means not shown.

In the non-operative condition, push rod 73 of actuator 72 may be fully retracted (toward frame member 90). Upon sensing that a book 207 has been transported to a position in general juxtaposition over rotator platform 220, vacuum switch 312 is initiated to draw a vacuum by way of vacuum pump 79 through air lines 313 and 314, as well as air passages 228 and vacuum cups 222 so as to securely hold cover 217 of book 207 in a fixed position relative to rotator platform 220.

Subsequent to the operation of vacuum switch 312, and fixing the position of cover 217 relative to rotator platform 220, switch 17 is initiated to draw a vacuum through airline 25 by way of vacuum pump 79. Concurrently, actuator 72 is acted upon by way of air control 79 and air line 78 so as to permit push rod 73 to travel away from cylinder 72 and fall downward by way of gravity until sensing platform 10 is adhered to book cover 217 by way of vacuum action through vacuum cups 12. It should be noted, that binding side 228 of book 207 is held in fixed relationship to cover 217, and specifically to rotator platform 220 through the structural arrangement of the book covers and binding.

In turn, air control 79 is operated so as to retract push rod 73 away from book 207 toward frame member 90. In turn, reference platform 20 begins to pull away from book 207, and more specifically cover 217. Concurrently, sensing platform 10 also pulls away from cover 217. However, the vacuum action through vacuum cups 222, as well as gravity, is such that cover 217 adheres to rotator platform 220. The combination of these two actions, namely cover 217 and binding 228 adhering to rotator platform 220 in fixed arrangement, and reference platform 20 pulling upward away from the rest position of cover 227 causes a lifting of cover 227 relative to binding 228 and cover 217, as depicted in FIG. 6. Because of binding 228, equal forces are exerted against sensing platform 10 such that sensing platform 10 begins to pivot relative to reference platform 20 by way of joint 30.

For the scenario of book 207 relative to rotator platform 220 as depicted in the drawings, detector device 40*a* will sense the proximity of extension member 19*a,* while sensing devices 40*b,* 40*c,* and 40*d* will continue not to sense the proximity of extension members 19*b,* 19*c,* and 19*d,* respectively. Accordingly, "tripping" of sensing device 40*a* is indicative of the binding being located on the side of reference platform 20 associated with the extension member opposite the extension member that was sensed, namely 19*a*. It should be clearly understood, tripping of one of the sensing devices 40*a–d* is sufficient to determine which side of book 207 that the binding is located.

In one embodiment of the invention, it is desired that books have a predetermined book binding orientation subsequent to determining the binding location by way of book binding locator 100 in accordance with the present invention, and further transport book 207 along transport conveyor 200 toward position A as seen in FIG. 2.

As depicted in FIG. 3, thereshown is an exemplary electromechanical control system 800 including a signal controller 801 and electromechanical operating system for rotating book 207 in response to a "shelf control input" or "orientation control signal" 810, and the orientation sensing signal indicative of the present location of the binding 228 currently being located as represented by way of the outputs of sensing devices 40*a–d* indicated as inputs A, B, C, and D, respectively.

As illustrated in FIG. 3, cross-shaped platform 220 includes a rod member perpendicular thereto. A lifting means is coupled to rod 803 for raising platform 220 relative to conveyor roller 210 and 215 in response to a raise command signal on signal line 812. Additionally, a rotating means 804 is coupled to rod 803 for rotating platform 220, and more particularly the position of biding 228 relative to the transport conveyor 200 in response to a rotate command signal on signal line 813.

In accordance with the present invention, signal controller 801 is configured to provide the aforesaid raise and rotate command signals 812 and 813, respectively, in response to the shelf control input signal 810 so as to orient book 207 before being transported away from the book binding locator 100 toward position B.

Signal controller 801 further represents the integration of vacuum switch control signals designated by signal line 815 for proper sequence of vacuum pumps 16 and 310, vacuum switches 17 and 312, as well air control 79 in a manner well known to those skilled in the art.

It should be noted that the arrangement parts and selection of components may be other than that as depicted in the drawings. More specifically the type of sensing devices and method and arrangement of air passages may be altered, as well as type and arrangement of pivotal points. The arrangement of components are intended to be such so as to detect the orientation of the sensing platform relative to the reference platform, and more specifically the rotator platform, upon lifting the reference platform while the sensing platform is adhering to a cover of a book, all of which are intended to be within the true spirit and scope of the present invention.

It should also be noted that there exists a wide array of sensing schemes for determining the orientation of the sensing platform relative to reference platform, and more specifically the rotator platform, all of which are intended to be within the true spirit and scope of the present invention.

What is claimed is:

1. A method for determining the orientation of a binding of a book-like material wherein the book-like material is defined by first and second opposing covers in hinged relationship by way of the binding, the method comprising the steps of:

positioning said book-like material onto a first platform with said first cover lying on said first platform;

temporarily adhering said second cover of said book-like material to a second platform where said second platform is pivotally coupled to a lifting member;

lifting said lifting member in a direction away from said first platform so as to cause said second cover to open relative to said first cover; and sensing orientation of said second platform relative to said first platform resulting from said second cover being open relative to said first cover.

2. The method of claim 1 wherein the step of adhering said second cover to said second platform is by way of a vacuum operated coupling.

3. The method of claim 1 wherein:

the step of adhering said second cover to said second platform is by way of a vacuum operated coupling, and said first cover is adhered to said first platform by way of a vacuum operated coupling.

4. A method for handling book-like materials in an automated library materials handling system including a motorized conveyor transport system for transporting said book-like materials from a first conveyor position to a second conveyor position so that each book-like material has a selected binding orientation at said second conveyor position in response to a orientation control signal, and where each book-like material includes first and second opposing covers in hinged relationship by way of the binding, the method comprising the steps of:

transporting, by way of said motorized conveyor transport system, a book-like library material from said first conveyor position to a position so as to be generally over a first platform with said first cover being in juxtaposition with said first platform;

positioning a second platform, pivotally suspended from a lifting member, so as to be in juxtaposition with said second cover;

temporarily adhering said second cover of said book-like material to said second platform;

lifting said lifting member in a direction away from said first platform so as to cause said second cover to open relative to said first cover; and sensing orientation of said second platform relative to said first platform resulting from said second cover being open relative to said first cover, and providing an orientation sensing signal representative of orientation of said book-like material relative to said conveyor transport system.

5. The method of claim 4 wherein the step of adhering said second cover to said second platform is by way of a vacuum operated coupling.

6. The method of claim 4 wherein:

the step of adhering said second cover to said second platform is by way of a vacuum operated coupling, and said first cover is adhered to said first platform by way of a vacuum operated coupling.

7. The method of claim 4 further comprising the steps of:

releasing said second cover from said second platform; and selectively, in response to said orientation control signal and said orientation sensing signal, raising said first platform from a rest position relative to said conveyor transport system, rotating said first platform relative to said conveyor transport system so as to orient said book-like material relative to said conveyor transport system in accordance with said orientation control signal, and lowering said first platform to said rest position; and transporting said book-like material to said second conveyor position having said selected orientation of said binding relative to said conveyor transport system.

8. The method of claim 7 wherein the step of adhering said second cover to said second platform is by way of vacuum operated couplings.

9. The method of claim 7 wherein:

the step of adhering said second cover to said second platform is by way of vacuum operated couplings, and said first cover is adhered to said first platform by way of vacuum operated couplings.

10. A apparatus for determining the orientation of a binding of a book-like material wherein the book-like material is defined by first and second opposing covers in hinged relationship by way of the binding, the apparatus comprising:

a first platform for supporting said book-like material with said first cover lying on said first platform;

an actuator means supported from a frame member, where said frame member is in fixed relationship to said first platform, and where said actuator includes a linearly moveable rod member;

a second platform pivotally coupled to said rod member;

first adhering means for temporarily adhering said second cover to said second platform in response to an adhere signal;

sensing means rigidly coupled to said rod member for sensing orientation of said second platform relative to said rod member for providing an orientation sensing signal indicative of the orientation of said binding of said book-like material; and control means for sequentially causing, said rod member to lower to a position sufficient to permit said second platform to adhere to said second cover in response to said adhere signal, said rod member to raise to a position sufficient to cause said second cover to open relative to said first cover and permit said sensing means to provide said orientation signal indicative of orientation of said binding of said book-like material, and releasing said second cover from said second platform.

11. The apparatus of claim 10 further comprising:

a sensing platform rigidly fixed to an end of said rod member, and resiliently coupled to said second platform; and wherein said sensing means includes first, second third, and fourth sensors rigidly coupled to said sensing platform, where said first and second sensors are aligned with a first reference axis, and said third and fourth sensors are aligned with a second reference axis intersecting said first reference axis and perpendicular thereto;

wherein said second platform includes first, second third, and fourth extension members rigidly coupled to said sensing platform and extending away from said first second platform toward said sensing platform, where said first and second extension members are aligned with a third reference axis, and said third and fourth extension members are aligned with a fourth reference axis intersecting said third reference axis and perpendicular thereto; and wherein said first, second, third, and forth sensors and said first, second, third, and extension members are correspondingly arranged, respectively, such that orientation of said second platform relative to said sensing platform may be determined.

12. The apparatus of claim 11 further comprising a suspension joint for pivotally suspending said second platform relative to said sensing platform.

13. The apparatus of claim 10 wherein said first adhering means includes at least one vacuum coupling coupled to a vacuum pump for adhering said second cover in juxtaposition with said second platform.

14. The apparatus of claim 10 further comprising:

a second adhering means for temporarily adhering said first cover to said first platform in response to an adhere signal where said second adhering means includes at least one coupling coupled to a vacuum pump for adhering said first cover in juxtaposition with said first platform; and said first adhering means includes at least one vacuum coupling coupled to a vacuum pump for adhering said second cover in juxtaposition with said second platform.

15. The apparatus of claim 10 wherein said actuator means is an air actuated linear actuator.

16. The apparatus of claim 11 further comprising a plurality of resilient members for resiliently coupling said second platform to said sensing platform.

17. The apparatus of claim 10 where said sensing means includes a plurality of electric eye proximity type sensing devices.

18. The apparatus of claim 11 where said sensing means includes a plurality of electric eye proximity type sensing devices.

19. The apparatus of claim 10 where said actuator means is resiliently suspended from said frame member.

20. An automated library materials handling system for transporting book-like materials from a first conveyor position to a second conveyor position so as to have a selected binding orientation in response to an orientation control signal, and where each book-like material includes first and second opposing covers in hinged relationship by way of the binding, the system comprising:

a motorized conveyor transport system for transporting said book-like material from said first conveyor position to a position over a first platform with said first cover being in juxtaposition with said first platform, and where said first platform is generally in planar alignment with a planar surface formed by a plurality of conveyors of said conveyor transport system;

an actuator means supported from a frame member, where said frame member is in fixed relationship to said first platform, and where said actuator includes a linearly moveable rod member;

a second platform pivotally coupled to said rod member;

first adhering means for temporarily adhering said second cover to said second platform in response to an adhere signal;

sensing means rigidly coupled to said rod member for sensing orientation of said second platform relative to said rod member for providing an orientation sensing signal indicative of the orientation of said binding of said book-like material; and control means for sequentially causing, said rod member to lower to a position sufficient to permit said second platform to adhere to said second cover in response to said adhere signal, said rod member to raise to a position sufficient to cause said second cover to open relative to said first cover and permit said sensing means to provide said orientation sensing signal indicative of orientation of said binding of said book-like material, and releasing said second cover from said second platform.

21. The apparatus of claim 20 further comprising:

first platform control means including, means for raising and lowering said first platform, in response to a platform height command signal, relative to said conveyor planar surface, and rotating means for selectively rotating said first platform in response to a rotation command signal so as to orient said book-like material relative to said conveyor transport; and wherein said control means includes means for selectively providing said platform height command signal and said rotation command signal in response to said book binding orientation command signal and said orientation sensing signal from said sensing means so that book-like material has said selected orientation at said second conveyor position.

22. The apparatus of claim 20 further comprising:

a sensing platform rigidly fixed to an end of said rod member, and resiliently coupled to said second platform; and wherein said sensing means includes first, second third, and fourth sensors rigidly coupled to said sensing platform, where said first and second sensors are aligned with a first reference axis, and said third and fourth sensors are aligned with a second reference axis intersecting said first reference axis and perpendicular thereto;

wherein said second platform includes first, second third, and fourth extension members rigidly coupled to said sensing platform and extending away from said first second platform toward said sensing platform, where said first and second extension members are aligned with a third reference axis, and said third and fourth extension members are aligned with a fourth reference axis intersecting said third reference axis and perpendicular thereto; and wherein said first, second, third, and forth sensors and said first, second, third, and extension members are correspondingly arranged, respectively, such that orientation of said second platform relative to said sensing platform may be determined.

23. The apparatus of claim 21 further comprising a suspension joint for pivotally suspending said second platform relative to said sensing platform.

24. The apparatus of claim 20 wherein said first adhering means includes at least one vacuum coupling coupled to a vacuum pump for adhering said second cover in juxtaposition with said second platform.

25. The apparatus of claim 20 further comprising:

a second adhering means for temporarily adhering said first cover to said first platform in response to an adhere signal where said second adhering means includes at least one coupling coupled to a vacuum pump for adhering said first cover in juxtaposition with said first platform; and said first adhering means includes at least one vacuum coupling coupled to a vacuum pump for adhering said second cover in juxtaposition with said second platform.

26. The apparatus of claim 20 wherein said actuator means is an air actuated linear actuator.

27. The apparatus of claim 21 further comprising a plurality of resilient members for resiliently coupling said second platform to said sensing platform.

28. The apparatus of claim 20 where said sensing means includes a plurality of electric eye proximity type sensing devices.

29. The apparatus of claim 20 where said actuator means is resiliently suspended from said frame member.

* * * * *